US010112279B2

(12) United States Patent
Xue et al.

(10) Patent No.: US 10,112,279 B2
(45) Date of Patent: Oct. 30, 2018

(54) SIZE-ADJUSTABLE ADAPTIVE ONLINE WHEEL DEBURRING DEVICE

(71) Applicant: CITIC Dicastal Co., LTD, Qinhuangdao (CN)

(72) Inventors: Bowen Xue, Qinhuangdao (CN); Zhixue Wang, Qinhuangdao (CN); Jiandong Guo, Qinhuangdao (CN); Yao Zheng, Qinhuangdao (CN)

(73) Assignee: CITIC Dicastal CO., LTD, Qinhuangdao (CN)

( * ) Notice: Subject to any disclaimer, the term of this patent is extended or adjusted under 35 U.S.C. 154(b) by 0 days.

(21) Appl. No.: 15/412,284

(22) Filed: Jan. 23, 2017

(65) Prior Publication Data

US 2017/0209976 A1 Jul. 27, 2017

(30) Foreign Application Priority Data

Jan. 23, 2016 (CN) ..... 2016 1 0043280

(51) Int. Cl.

| | |
|---|---|
| ***B24B 5/44*** | (2006.01) |
| ***B24B 21/12*** | (2006.01) |
| ***B24B 9/04*** | (2006.01) |
| ***B24B 21/16*** | (2006.01) |
| ***B24B 19/00*** | (2006.01) |

(52) U.S. Cl.

CPC ..... *B24B 5/44* (2013.01); *B24B 9/04* (2013.01); *B24B 19/00* (2013.01); *B24B 21/12* (2013.01); *B24B 21/16* (2013.01)

(58) Field of Classification Search

CPC .... B24B 5/44; B24B 9/02; B24B 9/04; B24B 19/00; B24B 21/12; B24B 21/16

USPC ..... 451/303, 307, 311

See application file for complete search history.

(56) References Cited

U.S. PATENT DOCUMENTS

| | | | | |
|---|---|---|---|---|
| 3,258,804 A * | 7/1966 | Fowle | B24B 5/225 15/104.011 |
| 4,216,560 A * | 8/1980 | Schmidt | B24B 41/06 15/268 |
| 2013/0102233 A1* | 4/2013 | Cheon | B24B 27/033 451/331 |

FOREIGN PATENT DOCUMENTS

| | | | |
|---|---|---|---|
| CN | 203438027 | * | 2/2014 |
| JP | 3044289 B2 | * | 5/2000 |
| JP | 3091417 B2 | * | 9/2000 |

* cited by examiner

*Primary Examiner* — Eileen Morgan

(74) *Attorney, Agent, or Firm* — Maier & Maier, PLLC

(57) ABSTRACT

A size-adjustable adaptive online wheel deburring device, including a synchronous clamping and rotating system for fixing and rotating a wheel, a left brush system, and a right brush system. The left brush system includes a first belt-type brush with a T-shaped synchronous belt at its inner side and bristles at its outer side, and a first automatically adjusting mechanism for changing a shape of the first brush by engaging the T-shaped synchronous belt so that the shape of the first brush is able to match different back cavity shapes of the wheel during burr removal. The right brush system includes a second belt-type brush and a second automatically adjusting mechanism for changing a shape of the second brush so that the second brush is constantly in three-point contact with a position of the wheel to be deburred during the burr removal.

1 Claim, 4 Drawing Sheets

SIZE-ADJUSTABLE ADAPTIVE ONLINE WHEEL DEBURRING DEVICE

TECHNICAL FIELD

The invention relates to a wheel deburring device, in particular to a size-adjustable adaptive online wheel deburring device.

BACKGROUND ART

In the field of aluminum alloy wheel production, to remove burrs after machining of a back cavity is a very difficult problem faced by all enterprises; currently a large disc brush is used to brush off burrs from the wheel back cavity on special equipment, which gives quite acceptable effects for wheels with smooth front shapes, but gives removal effects hardly to meet the use requirements for most wheels; at the same time, almost all production enterprises are conducting mixed line production, that is, wheels with different sizes, wheel widths and back cavity shapes are circulated simultaneously on a conveying roller bed. At present, there is no flexible equipment to meet the requirements of mixed line deburring.

SUMMARY OF THE INVENTION

The invention has an object to provide a size-adjustable adaptive online wheel deburring device which can automatically adjust the shapes of a left brush system and a right brush system according to information such as the diameter of a wheel and the shape of a back cavity, enabling those shapes to match with the wheel back cavity and focused processing to be carried out on corners of flange and rim roots.

A size-adjustable adaptive online wheel deburring device, comprising a synchronous clamping and rotating system for fixing and rotating a wheel, a left brush system for brushing off burrs of back cavities of the wheel, and a right brush system for brushing off burrs of corners of flange and rim roots of the wheel, wherein the left and right brush systems are fixed by means of a fixing plate to a driving shaft of a driving motor mounted in a frame of the synchronous clamping and rotating system, and wherein the driving motor can drive the left and right brush systems to rotate at the same time in a direction opposite to a rotation direction of the wheel, wherein the left brush system includes a first belt-type brush with a T-shaped synchronous belt at its inner side and bristles at its outer side, and a first automatically adjusting mechanism for changing a shape of the first brush by engaging the T-shaped synchronous belt so that the shape of the first brush is able to match different back cavity shapes of the wheel during burr removal, and wherein the right brush system includes a second belt-type brush and a second automatically adjusting mechanism for changing a shape of the second brush so that the second brush is constantly in three-point contact with a position of the wheel to be deburred during the burr removal.

In order to achieve the above-mentioned object, a technical scheme of the invention is that: the invention comprises a frame, a first driving motor, a lifting cylinder, a bottom plate, a lifting plate, first guide sleeves, first guide posts, a large bearing block, a driving shaft, a top plate, gears, racks, a synchronous guide rail, a left sliding plate, small bearing blocks, synchronous shafts, V-shaped rollers, a right sliding plate, a clamping cylinder, a second driving motor, a fixing plate, a first left guide wheel, a left tension wheel, a second left guide wheel, a first servo electric cylinder, a left support, a left supporting rod, a first left working wheel, an overturning plate, a left adjusting wheel, a right support, a right supporting rod, a right adjusting wheel, a second left working wheel, a first belt-type brush, a second servo electric cylinder, a left tension cylinder, second guide posts, second guide sleeves, a third servo electric cylinder, a first left lower support, a first guide rail, a first left upper support, a first pulley, a first synchronous belt, a second pulley, a first servo motor, a left fixture, a second servo motor, a fourth servo electric cylinder, a second left lower support, a second guide rail, a second left upper support, a third pulley, a second synchronous belt, a fourth pulley, a third servo motor, a baseplate, a fifth servo electric cylinder, a first right lower support, a third guide rail, a first right upper support, a fifth pulley, a third synchronous belt, a fourth servo motor, a sixth pulley, a sixth servo electric cylinder, third guide sleeves, third guide posts, a right tension cylinder, a right fixture, a right support, fourth guide sleeves, fourth guide posts, springs, a floating support, a seventh servo electric cylinder, a second right lower support, a fourth guide rail, a second right upper support, a seventh pulley, a fourth synchronous belt, an eighth pulley, a fifth servo motor, an eighth servo electric cylinder, a second belt-type brush, a first right working wheel, a right supporting wheel, a second right working wheel, a ninth servo electric cylinder, a first right guide wheel, a right tension wheel and a second right guide wheel.

A synchronous clamping and rotating system comprises a frame, a first driving motor, lifting cylinders, a bottom plate, a lifting plate, first guide sleeves, first guide posts, a large bearing block, a driving shaft, a top plate, gears, racks, a synchronous guide rail, a left sliding plate, small bearing blocks, synchronous shafts, V-shaped rollers, a right sliding plate, a clamping cylinder and a second driving motor. Four first guide posts are fixed between the bottom plate and the top plate, and four first guide sleeves matched with the first guide posts are mounted on the lifting plate; the first driving motor is mounted at the bottom of the lifting plate, the large bearing block is mounted at the top of the lifting plate, the driving shaft is mounted in the large bearing block through a bearing, and the output end of the first driving motor is connected with the lower end of the driving shaft; two lifting cylinders are mounted on the bottom plate, and the output ends of the lifting cylinders are hinged with the bottom of the lifting plate; two racks are fixed respectively at the bottoms of the left sliding plate and right sliding plate, two small bearing blocks are fixed respectively at the tops of the left sliding plate and right sliding plate, and the two small bearing blocks are mounted at the top of the top plate through the synchronous guide rail; the synchronous shafts at the tops of which the V-shaped rollers are respectively mounted are mounted respectively in the small bearing blocks; the second driving motor is fixed to the bottom of the right sliding plate, and the output end of the second driving motor is connected with one of the synchronous shafts; the clamping cylinder is fixed on the side of the frame, and the output end of the frame is connected with the right sliding plate; the racks are meshed with the gears mounted at the top of the top plate.

A left brush system comprises a fixing plate, a first left guide wheel, a left tension wheel, a second left guide wheel, a first servo electric cylinder, a left support, a left supporting rod, a first left working wheel, an overturning plate, a left adjusting wheel, a second left working wheel, a first belt-type brush, a second servo electric cylinder, a second left tension cylinder, second guide posts, second guide sleeves, a third servo electric cylinder, a first left lower support, a first guide rail, a first left upper support, a first pulley, a first synchronous belt, a second pulley, a first servo motor, a left fixture, a second servo motor, a fourth servo electric cylinder, a second left lower support, a second guide rail, a second left upper support, a second pulley, a second synchronous belt, a fourth pulley and a third servo motor. The first left guide wheel and the second left guide wheel are fixed in corresponding positions at the bottom of the fixing plate; both the left tension cylinder and the two second guide sleeves are also fixed in the corresponding positions at the bottom of the fixing plate and are disposed between the first left guide wheel and the second left guide wheel; the two second guide posts matched with the second guide sleeves are fixed at the top of the left fixture, and the output end of the left tension cylinder is connected with the left fixture; the left tension wheel is mounted on the left fixture; both the first servo electric cylinder and the first left lower support are hinged to the top of the fixing plate, and meanwhile, the output end of the first servo electric cylinder is hinged with the first left lower support; two sides of the first left upper support and two sides of the first left lower support are connected through the guide rail, and the third servo electric cylinder is hinged between a bottom plate of the first left lower support and a bottom plate of the first left upper support; the first servo motor is fixed at the top of the bottom plate of the first left upper support, and the output end of the first servo motor is provided with the first pulley; the second pulley is arranged in the middle of the first left working wheel mounted at the top of the first left upper support, and the first pulley and the second pulley are connected through the first synchronous belt; the left support and the right support are fixed in the corresponding positions at the top of the fixing plate; the left adjusting wheel is mounted at the upper end of the left supporting rod, and slide slots at two sides of the left supporting rod are matched with bearings on two sides of the left support; the right adjusting wheel is mounted at the upper end of the right supporting rod, and slide slots at two sides of the right supporting rod are matched with bearings on two sides of the right support; two ends of the overturning plate are hinged respectively with the lower ends of the left supporting rod and right supporting rod, the second servo motor is fixed in the corresponding position of the fixing plate, and the output end of the second servo motor is connected with the middle of the overturning plate; both the bottoms of the second servo electric cylinder and the second left lower support are hinged to the top of the fixing plate; meanwhile, the output end of the second servo electric cylinder is hinged with the second left lower support; two sides of the second left upper support and two sides of the second left lower support are connected through the second guide rail; the fourth servo electric cylinder is hinged between a bottom plate of the second left lower support and a bottom plate of the second left upper support; the third servo motor is fixed at the top of the bottom plate of the second left upper support, and the output end of the third servo motor is provided with the third pulley; the fourth pulley is mounted in the middle of the second left working wheel, and the third pulley and the fourth pulley are connected through the second synchronous belt; the first belt-type brush with a T-shaped synchronous belt at its inner side and bristles at its outer side is meshed simultaneously with the first left guide wheel, the left tension wheel, the second left guide wheel, the first left working wheel, the left adjusting wheel, the right adjusting wheel and the second left working wheel.

A right brush system comprises a right support, a right supporting rod, a right adjusting wheel, a baseplate, a fifth servo electric cylinder, a first right lower support, a third guide rail, a first right upper support, a fifth pulley, a third synchronous belt, a fourth servo motor, a sixth pulley, a sixth servo electric cylinder, third guide sleeves, third guide posts, a right tension cylinder, a right fixture, a right support, fourth guide sleeves, fourth guide posts, springs, a floating support, a seventh servo electric cylinder, a second right lower support, a fourth guide rail, a second right upper support, a seventh pulley, a fourth synchronous belt, an eighth pulley, a fifth servo motor, an eighth servo electric cylinder, a belt-type brush, a first right working wheel, a right support wheel, a second right working wheel, a ninth servo electric cylinder, a first right guide wheel, a right tension wheel and a second right guide wheel. The fifth servo electric cylinder is hinged between the side of the fixing plate and the side of the baseplate; the first right guide wheel and the second right guide wheel are mounted in the corresponding positions at the bottom of the baseplate; both the two third guide sleeves and the right tension cylinder are fixed at the bottom of the baseplate and disposed between the first right guide wheel and second right guide wheel, the two third guide posts matched with the two third guide sleeves are mounted at the top of the fight fixture, the output end of the right tension cylinder is connected with the right fixture, and the right tension wheel is mounted at the bottom of the right fixture; both the bottoms of the first right lower support and eighth servo electric cylinder are hinged to the top of the baseplate, and meanwhile the output end of the eighth servo electric cylinder is hinged with the top of the first right lower support; two sides of the first right upper support and two sides of the first right lower support are connected through the third guide rail; the sixth servo electric cylinder is hinged between a bottom plate of the first right lower support and a bottom plate of the first right upper support; the fourth servo motor is fixed in the corresponding position at the top of the bottom plate of the first right upper support, and the output end of the fourth servo motor is provided with the sixth pulley; the first right working wheel is mounted at the top end of the first right upper support, and the first pulley is fixed in the middle of the first right working wheel; the fifth pulley and sixth pulley are connected through the third synchronous belt; the right support is fixed at the top of the baseplate, and the two guide sleeves are mounted at the top end of the right support, the two fourth guide posts matched with the fourth guide sleeves are mounted at the bottom of the floating support, the springs sleeve the two fourth guide posts and are disposed between the right support and the floating support; the right support wheel is mounted at the top of the floating support; both the bottoms of the second right lower support and ninth servo electric cylinder are hinged to the top of the baseplate, the output end of the ninth servo electric cylinder is hinged with the upper end of the second right lower support; two sides of the second right lower support and two sides of the second right upper support are connected through the fourth guide rail; the seventh servo electric cylinder is hinged between a bottom plate of the second right lower support and a bottom plate of the second right upper support; the fifth servo motor is fixed in the corresponding position at the top of the bottom plate of the second right upper support, and the output end of the fifth servo motor is provided with the seventh pulley; the second right working wheel is mounted at the top of the second right upper support, and the eighth pulley is mounted in the middle of the second right working wheel; the seventh pulley and eighth pulley are connected through the fourth synchronous belt; the second belt-type brush with a T-shaped synchronous belt at its inner side and bristles at its outer side is meshed simultaneously with the first right working wheel, the right support wheel, the second right working wheel, the first right guide wheel, the second right tension wheel and the right guide wheel.

In practical use, the information such as the diameter, back cavity shape of the wheel is input in advance to this device through a recognition system; the synchronous clamping and rotating system enables a wheel to rotate in a clamped state; the servo electric cylinders and the second servo motor adjust the first left working wheel, the left adjusting wheel, the right adjusting wheel and the left working wheel to respective corresponding positions, so that the shape of the first belt-type brush adapts in shape to the back cavity shape of the wheel exactly; the sixth, seventh, eighth, and ninth servo electric cylinders can adjust respectively the positions of the first right working wheel and second right working wheel according to the back cavity shape and the size of the wheel, the fifth servo electric cylinder can remove respectively the burrs on the flange root corners and rim root corners of the wheel by adjusting the angle of the right brush system, and it can be ensured that the second belt-type brush is constantly in three-point contact with the position of the wheel to be deburred during burr removal; after the left brush system and the right brush system have been adjusted to the proper posture, the first driving motor enables the left brush system and the right brush system to rotate at the same time and rotate in the direction opposite to the rotation direction of the wheel, and meanwhile, the first servo motor and the third servo motor can drive the first belt-type brush to rotate circularly, and the fourth servo motor and the fifth servo motor can drive the second belt-type brush to rotate circularly.

In the invention, in use, the shapes of the left brush system and right brush system can be adjusted to match with the back cavity of the wheel, and the corners of the flange root and rim root can be carried out with focused processing; meanwhile, the present invention has the advantages of high automation level, advanced process, simple structure and safe and stable performance.

Figure 1:
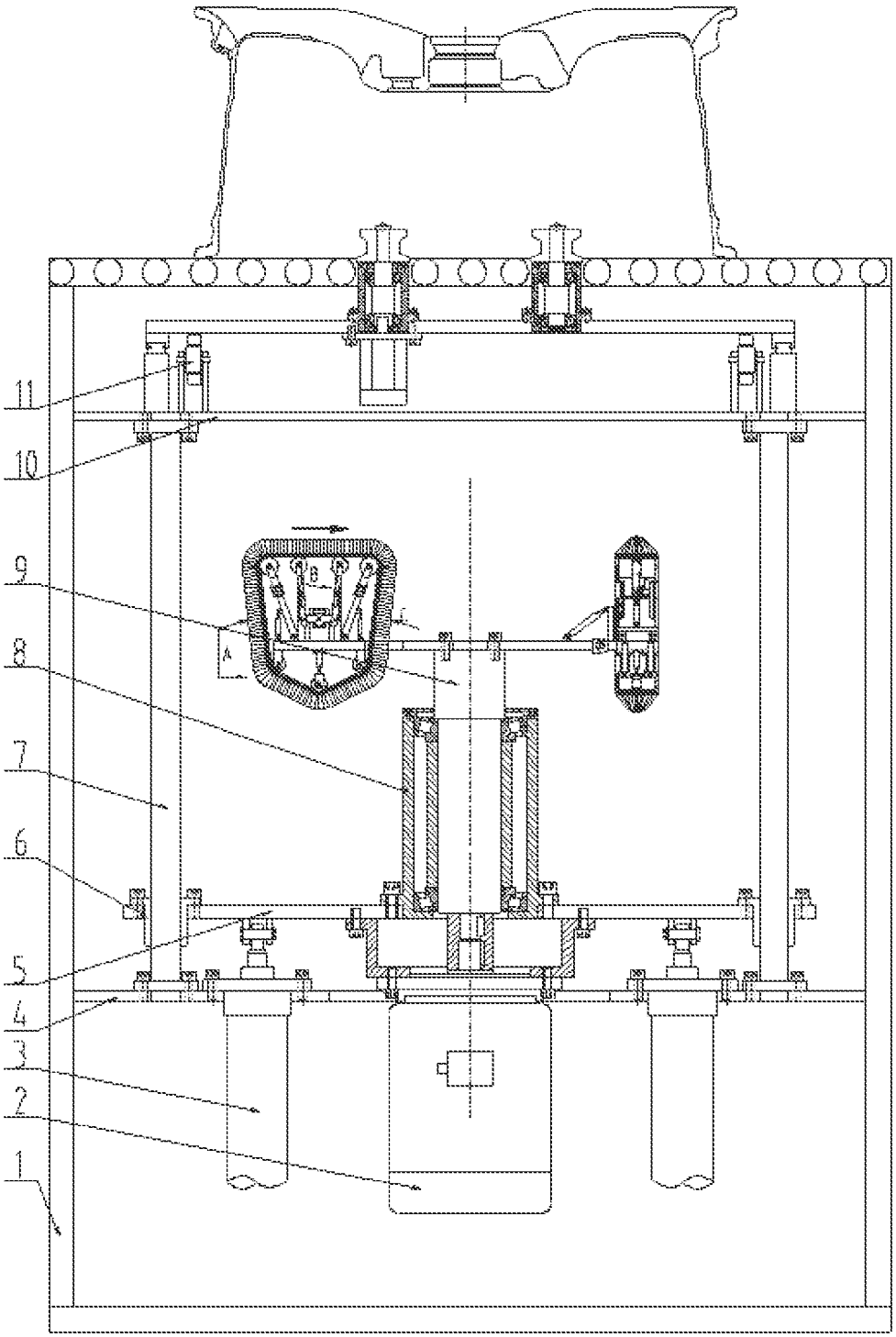
FIG. 1 is a front view of a size-adjustable adaptive online wheel deburring device of the invention.
Figure 2:
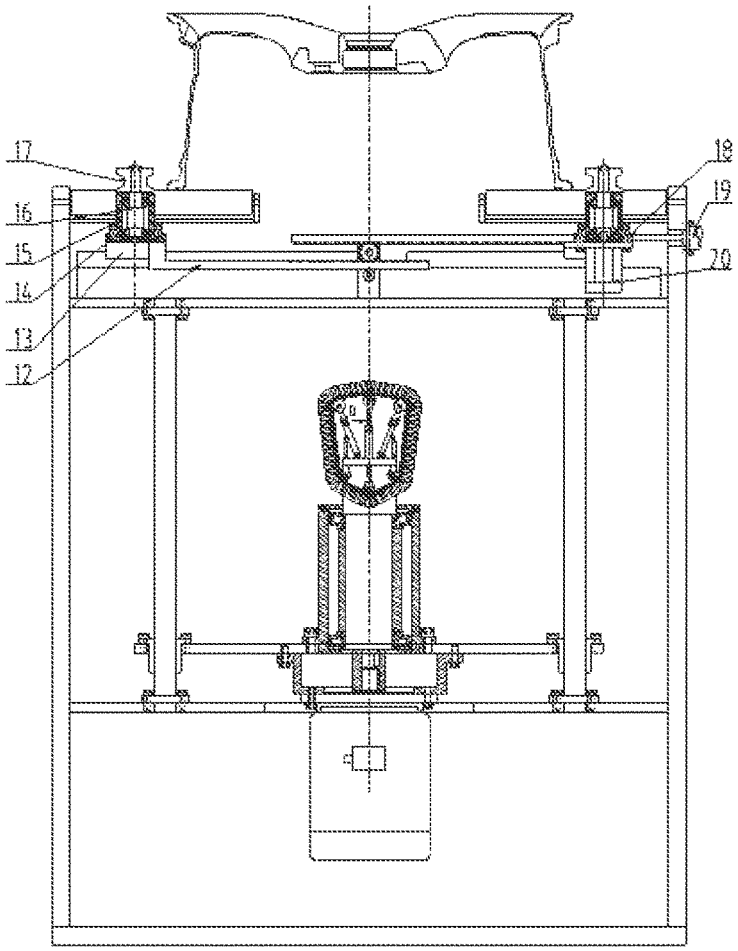
FIG. 2 is a left view of a size-adjustable adaptive online wheel deburring device of the invention.
Figure 3:
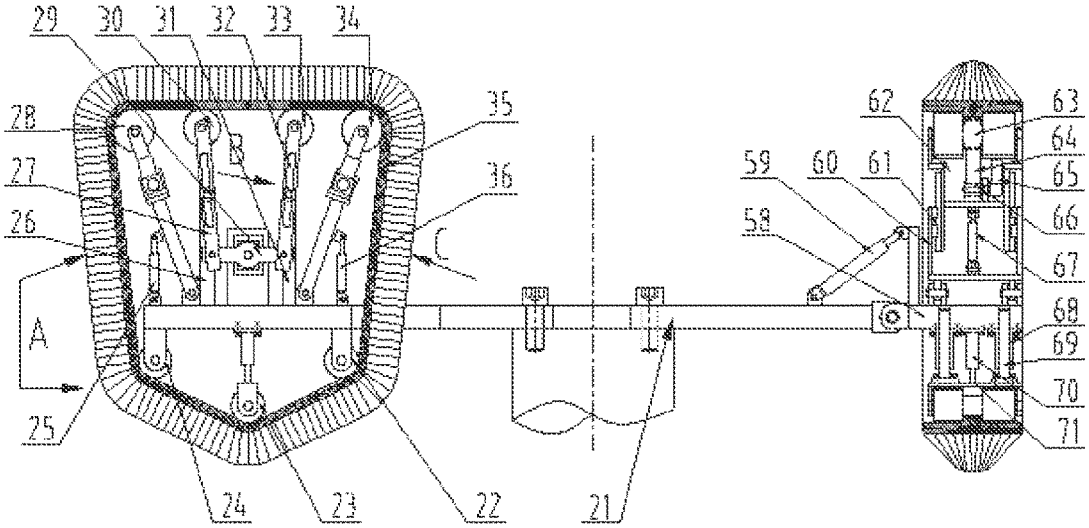
FIG. 3 is a partial front view of a size-adjustable adaptive online wheel deburring device of the invention.
Figure 4:
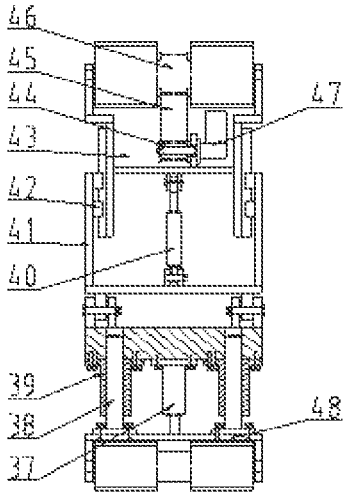
FIG. 4 is a sectional view of a size-adjustable adaptive online wheel deburring device of the invention in direction A.
Figure 5:
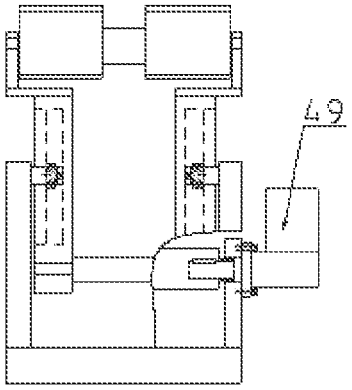
FIG. 5 is a sectional view of a size-adjustable adaptive online wheel deburring device of the invention in direction B.
Figure 6:
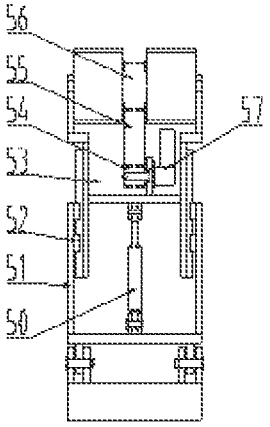
FIG. 6 is a sectional view of a size-adjustable adaptive online wheel deburring device of the invention in direction C.
Figure 7:
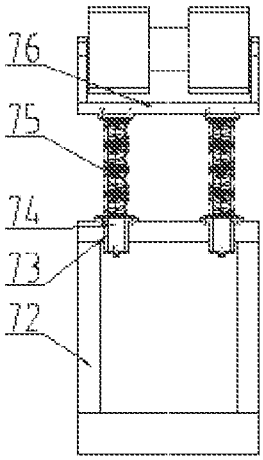
FIG. 7 is a sectional view of a size-adjustable adaptive online wheel deburring device of the invention in direction D.
Figure 8:
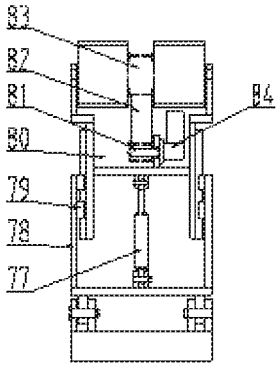
FIG. 8 is a sectional view of a size-adjustable adaptive online wheel deburring device of the invention in direction E.
Figure 9:
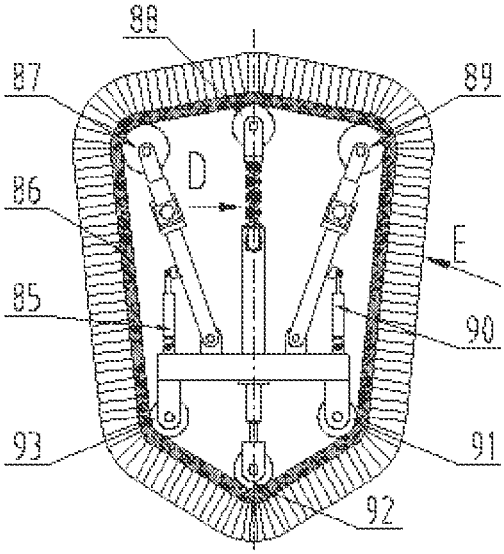
FIG. 9 is a front view of a right brush system of a size-adjustable adaptive online wheel deburring device of the invention.

In the drawings, 1—frame, 2—first driving motor, 3—lifting cylinder, 4—bottom plate, 5—lifting plate, 6—first guide sleeve, 7—first guide post, 8—large bearing block, 9—driving shaft, 10—top plate, 11—gear, 12—rack, 13—synchronous guide rail, 14—left sliding plate, 15—small bearing block, 16—synchronous shaft, 17—V-shaped roller, 18—right sliding plate, 19—clamping cylinder, 20—second driving motor, 21—fixing plate, 22—first left guide wheel, 23—left tension wheel, 24—second left guide wheel, 25—first servo electric cylinder, 26—left support, 27—left supporting rod, 28—first left working wheel, 29—overturning plate, 30—left adjusting wheel, 31—right support, 32—right supporting rod, 33—right adjusting wheel, 34—second left working wheel, 35—belt-type brush, 36—second servo electric cylinder, 37—left tension cylinder, 38—second guide post, 39—second guide sleeve, 40—third servo electric cylinder, 41—first left lower support, 42—first guide rail, 43—first left upper support, 44—first pulley, 45—first synchronous belt, 46—second pulley, 47—first servo motor, 48—left fixture, 49—second servo motor, 50—fourth servo electric cylinder, 51—second left lower support, 52—second guide rail, 53—second left upper support, 54—third pulley, 55—second synchronous belt, 56—fourth pulley, 57—third servo motor, 58—base-plate, 59—fifth servo electric cylinder, 60—first right lower support, 61—third guide rail, 62—first right upper support, 63—fifth pulley, 64—third synchronous belt, 65—fourth servo motor, 66—sixth pulley, 67—sixth servo electric cylinder, 68—third guide sleeve, 69—third guide post, 70—right tension cylinder, 71—right fixture, 72—right support, 73—fourth guide sleeve, 74—fourth guide post, 75—spring, 76—floating support, 77—seventh servo electric cylinder, 78—second right lower support, 79—fourth guide rail, 80—second right upper support, 81—fourth pulley, 82—fourth synchronous belt, 83—eighth pulley, 84—fifth servo motor, 85—eighth servo electric cylinder, 86—belt-type brush, 87—first right working wheel, 88—right support wheel, 89—second right working wheel, 90—ninth servo electric cylinder, 91—first right guide wheel, 92—right tension wheel, and 93—second right guide wheel.

DETAILED DESCRIPTION OF THE INVENTION

The details and working condition of the specific device disclosed according to the invention will be described below with reference to the drawings.

The device comprises a frame 1, a first driving motor 2, lifting cylinders 3, a bottom plate 4, a lifting plate 5, first guide sleeves, first guide posts, a large bearing block 8, a driving shaft 9, a top plate 10, gears 11, racks 12, a synchronous guide rail 13, a left sliding plate 14, small bearing blocks 15, synchronous shafts 16, V-shaped rollers 17, a right sliding plate 18, a clamping cylinder 19, a second driving motor 20, a fixing plate 21, a first left guide wheel 22, a left tension wheel 23, a second left guide wheel 24, a first servo electric cylinder 25, a left support 26, a left supporting rod 27, a first left working wheel 28, an overturning plate 29, a left adjusting wheel 30, a right support 31, a right supporting rod 32, a right adjusting wheel 33, a second left working wheel 34, a belt-type brush 35, a second servo electric cylinder 36, a left tension cylinder 37, second guide posts 38, second guide sleeves 39, a third servo electric cylinder 40, a first left lower support 41, a first guide rail 42, a first left upper support 43, a first pulley 44, a first synchronous belt 45, a second pulley 46, a first servo motor 47, a left fixture 48, a second servo motor 49, a fourth servo electric cylinder 50, a second left lower support 51, a second guide rail 52, a second left upper support 53, a third pulley 54, a second synchronous belt 55, a fourth pulley 56, a third servo motor 57, a baseplate 58, a fifth servo electric cylinder 59, a right lower support I 60, a third guide rail 61, a first right upper support 62, a fifth pulley 63, a third synchronous belt 64, a fourth servo motor 65, a sixth pulley 66, a sixth servo electric cylinder 67, third guide sleeves 68, third guide posts 69, a right tension cylinder 70, a right fixture 71, a right support 72, fourth guide sleeves 73, fourth guide posts 74, springs 75, a floating support 76, a seventh servo electric cylinder 77, a second right lower support 78, a fourth guide rail 79, a second right upper support 80, a fourth pulley 81, a fourth synchronous belt 82, a eighth pulley 83, a fifth servo motor 84, an eighth servo electric cylinder 85, a belt-type brush 86, a first right working wheel 87, a right support wheel 88, a second right working wheel 89, a ninth servo electric cylinder 90, a first right guide wheel 91, a right tension wheel 92, and a second right guide wheel 93.

A synchronous clamping and rotating system comprises a frame 1, a first driving motor 2, lifting cylinders 3, a bottom plate 4, a lifting plate 5, first guide sleeves 6, guide posts 7, a large bearing block 8, a driving shaft 9, a top plate 10, gears 11, racks 12, a synchronous guide rail 13, a left sliding plate 14, small bearing blocks 15, synchronous shafts 16, V-shaped rollers 17, a right sliding plate 18, a clamping cylinder 19 and a second driving motor 20. The four first guide posts 7 are fixed between the bottom plate 4 and the top plate 10, and the four first guide sleeves 6 matched with the first guide posts 7 are mounted on the lifting plate 5; the first driving motor 2 is mounted at the bottom of the lifting plate 5, the large bearing block 8 is mounted at the top of the lifting plate, the driving shaft 9 is mounted in the large bearing block 8 through a bearing, and the output end of the first driving motor 2 is connected with the lower end of the driving shaft 9; the two lifting cylinders 3 are mounted on the bottom plate 4, and the output ends of the lifting cylinders are hinged with the bottom of the lifting plate 5; the two racks 12 are fixed respectively at the bottoms of the left sliding plate 14 and right sliding plate 18, the two small bearing blocks 15 are fixed respectively at the tops of the left sliding plate and right sliding plate, and the two small bearing blocks are mounted at the top of the top plate 10 through the synchronous guide rail 13; the synchronous shafts 16 at the tops of which the V-shaped rollers 17 are respectively mounted are mounted respectively in the small bearing blocks 15; the second driving motor 20 is fixed at the bottom of the right sliding plate 18, and the output end of the second driving motor is connected with one of the synchronous shafts 16; the clamping cylinder 19 is fixed on the side of the frame 1, and the output end of the frame is connected with the right sliding plate 18; the racks 12 are meshed with the gear 11 mounted at the top of the top plate 10.

The left brush system comprises a fixing plate 21, a first left guide wheel 22, a left tension wheel 23, a second left guide wheel 24, a first servo electric cylinder 25, a left support 26, a left supporting rod 27, a first left working wheel 28, an overturning plate 29, a left adjusting wheel 30, a second left working wheel 34, a first belt-type brush 35, a second servo electric cylinder 36, a left tension cylinder 37, second guide posts 38, second guide sleeves 39, a third servo electric cylinder 40, a first left lower support 41, a first guide rail 42, a first left upper support 43, a first pulley 44, a first synchronous belt 45, a second pulley 46, a first servo motor 47, a left fixture 48, a second servo motor 49, a fourth servo electric cylinder 50, a second left lower support 51, a second guide rail 52, a second left upper support 53, a third pulley 54, a second synchronous belt 55, a fourth pulley 56 and a third servo motor 57. The first left guide wheel 22 and the second left guide wheel 24 are fixed in the corresponding positions at the bottom of the fixing plate 21; the left tension cylinder 37 and the two second guide sleeves 39 are also fixed in the corresponding positions at the bottom of the fixing plate 21 and are disposed between the first left guide wheel 22 and the second left guide wheel 24; the two second guide posts 38 matched with the second guide sleeves 39 are fixed at the top of the left fixture 48, and the output end of the left tension cylinder 37 is connected with the left fixture 48; the left tension wheel 23 is mounted on the left fixture 48; the first servo electric cylinder 25 and the first left lower support 41 are hinged to the top of the fixing plate 21, and meanwhile, the output end of the first servo electric cylinder 25 is hinged with the first left lower support 41; two sides of the first left upper support 43 and two sides of the first left lower support 41 are connected through the first guide rail 42, and the third servo electric cylinder 40 is hinged between a bottom plate of the first left lower support 41 and a bottom plate of the first left upper support 43; the first servo motor 47 is fixed at the top of the bottom plate of the first left upper support 43, and the output end of the first servo motor 47 is provided with the first pulley 44; the second pulley 46 is disposed in the middle of the first left working wheel 28, the first left working wheel 28 is mounted at the top of the first left upper support 43, and the first pulley 44 is connected with the second pulley 46 through the first synchronous belt 45; both the left support 26 and the right support 31 are fixed in the corresponding positions at the top of the fixing plate 21; the left adjusting wheel 30 is mounted at the upper end of the left supporting rod 27, and slide slots at two sides of the left supporting rod 27 are matched with bearings at two sides of the left support 26; the right adjusting wheel 33 is mounted at the upper end of the right supporting rod 32, and slide slots at two sides of the right supporting rod 32 are matched with bearings at two sides of the right support 31; two ends of the overturning plate 29 are hinged respectively with the lower end of the left supporting rod 27 and the lower end of the right supporting rod 32, the second servo motor 49 is fixed at the corresponding position of the fixing plate 21, and the output end of the second servo motor 49 is connected with the middle of the overturning plate 29; both the bottoms of the second servo electric cylinder 36 and second left lower support 51 are hinged to the top of the fixing plate 21; meanwhile, the output end of the servo electric cylinder 36 is hinged with the second left lower support 51; two sides of the second left upper support 53 and two sides of the second left lower support 51 are connected through the second guide rail 52; the fourth servo electric cylinder 50 is hinged between a bottom plate of the second left lower support 51 and a bottom plate of the second left upper support 53; the third servo motor 57 is fixed at the top of the bottom plate of the second left upper support 53, and the output end of the third servo motor 57 is provided with the third pulley 54; the fourth pulley 56 is mounted in the middle of the second left working wheel 34, and the third pulley 54 is connected with the fourth pulley 56 through the second synchronous belt 55; the first belt-type brush 35 with a T-shaped synchronous belt at its inner side and bristles at its outer side is meshed simultaneously with the first left guide wheel 22, the left tension wheel 23, the second left guide wheel 24, the first left working wheel 28, the left adjusting wheel 30, the right adjusting wheel 33 and the second left working wheel 34.

The right brush system comprises a right support 31, a right supporting rod 32, a right adjusting wheel 33, a baseplate 58, a fifth servo electric cylinder 59, a first right lower support 60, a third guide rail 61, a first right upper support 62, a fifth pulley 63, a third synchronous belt 64, a fourth servo motor 65, a sixth pulley 66, a sixth servo electric cylinder 67, third guide sleeves 68, third guide posts 69, a right tension cylinder 70, a right fixture 71, a right support 72, fourth guide sleeves 73, fourth guide posts 74, springs 75, a floating support 76, a seventh servo electric cylinder 77, a second right lower support 78, a fourth guide rail 79, a second right upper support 80, a seventh pulley 81, a fourth synchronous belt 82, an eighth pulley 83, a fifth servo motor 84, an eighth servo electric cylinder 85, a second belt-type brush 86, a first right working wheel 87, a right support wheel 88, a second right working wheel 89, a ninth servo electric cylinder 90, a first right guide wheel 91, a right tension wheel 92 and a second right guide wheel 93. The fifth servo electric cylinder 59 is hinged between the side of the fixing plate 21 and the side of the baseplate 58; the first right guide wheel 91 and the second right guide wheel 93 are mounted in the corresponding positions at the bottom of the baseplate 58; both the two third guide sleeves 68 and the right tension cylinder 70 are also fixed at the bottom of the baseplate 58 and are disposed between the first right guide wheel 91 and the second right guide wheel 93, the two third guide posts 69 matched with the two third guide sleeves 68 are mounted at the top of the right fixture 71, and the output end of the right tension cylinder 70 is also connected with the right fixture 71, and the right tension wheel 92 is mounted at the bottom of the right fixture 71; both the bottom of the right lower support I 60 and the eighth servo electric cylinder 85 are hinged to the top of the baseplate 58, and the output end of the eighth servo electric cylinder 85 is hinged with the top of the first right lower support 60; the two sides of the right upper support I 62 and two sides of the first right lower support 60 are connected through the third guide rail 61; the sixth servo electric cylinder 67 is hinged between a bottom plate of the first right lower support 60 and a bottom plate of the right upper support I 62; the fourth servo motor 65 is fixed in the corresponding position at the top of the bottom plate of the first right upper support 62, and the output end of the fourth servo motor 65 is provided with the sixth pulley 66; the first right working wheel 87 is mounted at the top end of the first right upper support 62, and the fifth pulley 63 is fixed in the middle of the first right working wheel 87; the fifth pulley 63 is connected with the sixth pulley 66 through the third synchronous belt 64; the right support 72 is fixed at the top of the baseplate 58, the two fourth guide sleeves 73 are mounted at the top end of the right support 72, the two fourth guide posts 74 matched with the fourth guide sleeves 73 are fixed at the bottom of the floating support 76, and the springs 75 sleeve the two guide posts 74 and are disposed between the right support 72 and the floating support 76; the right supporting wheel 88 is mounted at the top of the floating support 76; both the bottoms of the second right lower support 78 and ninth servo electric cylinder 90 are hinged to the upper part of the baseplate 58, and the output end of the ninth servo electric cylinder 90 is hinged with the upper end of the second right lower support 78; two sides of the second right lower support 78 and two sides of the second right upper support 80 are connected through the fourth guide rail 79; the seventh servo electric cylinder 77 is hinged between a bottom plate of the second right lower support 78 and a bottom plate of the second right upper support 80; the fifth servo motor 84 is fixed in the corresponding position at the top of the bottom plate of the second right upper support 80, and the output end of the fifth servo motor 84 is provided with the seventh pulley 81; the second right working wheel 89 is mounted at the top of the second right upper support 80, and the eighth pulley 83 is fixed in the middle of the second right working wheel 89; the seventh pulley 81 is connected with the eighth pulley 83 through the fourth synchronous belt 82; the second belt-type brush with a T-shaped synchronous belt at its inner side and bristles at its outer side is meshed simultaneously with the first right guide wheel 87, the right support wheel 88, the second right working wheel 89, the right guide wheel 91, the right tension wheel 92 and the second right guide wheel 93.

In the working process, the information such as the diameter, back cavity shape of a wheel is input in advance to the device through a recognition system; the synchronous clamping and rotating system enables the wheel to rotate in a clamped state; the first servo electric cylinder 25, the second servo electric cylinder 36, the third servo electric cylinder 40, the fourth servo electric cylinder 50 and the second servo motor 49 adjust the first left working wheel 28, the left adjusting wheel 30, the right adjusting wheel 33 and the second left working wheel 34 to respective corresponding positions, and adapt the shape of the first belt-type brush 35 to the back cavity shape and the radius of the wheel exactly; the cylinder servo electric cylinder 67, the seventh servo electric cylinder 77, the eighth servo electric cylinder 85 and the ninth servo electric cylinder 90 can adjust respectively the positions of the first right working wheel 87 and second right working wheel 89 according to the back cavity shape and the size of the wheel, the fifth servo electric cylinder 59 can remove respectively the burrs on the flange root corners and rim root corners of the wheel by adjusting the angle of the right brush system, and it can be ensured that the second belt-type brush 86 is constantly in three-point contact with the position of the wheel to be deburred during burr removal; after the left brush system and the right brush system have been adjusted to the proper posture, the first driving motor 2 enables the left brush system and the right brush system to rotate at the same time and rotate in the direction opposite to the rotation direction of the wheel, and meanwhile, the first servo motor 47 and the third servo motor 57 drive the first belt-type brush 35 to rotate circularly, and the fourth servo motor 65 and the fifth servo motor 84 drive the second belt-type brush 86 to rotate circularly.

The invention claimed is:

1. A size-adjustable adaptive online wheel deburring device, comprising a synchronous clamping and rotating system for fixing and rotating a wheel, a left brush system for brushing off burrs of back cavities of the wheel, and a right brush system for brushing off burrs of corners of flange and rim roots of the wheel, wherein the left and right brush systems are fixed by means of a fixing plate to a driving shaft of a driving motor mounted in a frame of the synchronous clamping and rotating system, and wherein the driving motor can drive the left and right brush systems to rotate at the same time in a direction opposite to a rotation direction of the wheel, wherein the left brush system includes a first belt-type brush with a T-shaped synchronous belt at its inner side and bristles at its outer side, and a first automatically adjusting mechanism for changing a shape of the first brush by engaging the T-shaped synchronous belt so that the shape of the first brush is able to match different back cavity shapes of the wheel during burr removal, and wherein the right brush system includes a second belt-type brush and a second automatically adjusting mechanism for changing a shape of the second brush so that the second brush is constantly in three-point contact with a position of the wheel to be deburred during the burr removal.

* * * * *